United States Patent [19]

Bourque

[11] 4,331,276

[45] May 25, 1982

[54] DISPENSING OF ATTACHMENT MEMBERS

[75] Inventor: Donald L. Bourque, Millis, Mass.

[73] Assignee: Dennison Manufacturing Company, Framingham, Mass.

[21] Appl. No.: 73,582

[22] Filed: Sep. 7, 1979

[51] Int. Cl.[3] ..... B25L 1/02; B25L 7/00

[52] U.S. Cl. ..... 227/8; 227/1; 227/67; 227/156; 227/121

[58] Field of Search ..... 24/90 R, 150 FP; 29/417, 432, 433, 450; 206/343; 227/8, 1, 67, 68, 95, 96, 112, 115, 117, 121, 156; 264/145, 147, 167

[56] References Cited

U.S. PATENT DOCUMENTS

| | | | |
|---|---|---|---|
| 2,033,018 | 3/1936 | Weber | 227/121 |
| 2,667,637 | 2/1954 | Marano | 227/121 |
| 3,875,648 | 4/1975 | Bone | 29/432 X |
| 4,077,557 | 3/1978 | Green | 227/121 |
| 4,202,480 | 5/1980 | Annett | 227/121 X |

*Primary Examiner*—Paul A. Bell

*Attorney, Agent, or Firm*—George E. Kersey

[57] ABSTRACT

Dispensing of attachment members, each formed by a filament with a head at one end and a cross bar at the other end, using an ejector with forward and return strokes. Each attachment member is dispensed during the forward stroke of the ejector and an antijam mechanism is operated for assuring completion of the return stroke of the ejector and prevention of premature operation.

12 Claims, 9 Drawing Figures

DISPENSING OF ATTACHMENT MEMBERS

BACKGROUND OF THE INVENTION

This invention relates to the dispensing of attachment members and, more particularly, to the dispensing of attachment members from continuously connected fastener stock.

Techniques for dispensing attachment members from continuously connected fastener stock are disclosed in U.S. Pat. No. 4,121,487, issued Oct. 24, 1978; U.S. Pat. No. 4,039,078, issued Aug. 2, 1977 and U.S. Pat. No. 3,948,128 issued Apr. 6, 1976. In these patents fastener attachment stock is formed by continuously connected plastic side members that are intercoupled by a plurality of cross links. The stock may be produced from flexible plastic materials, such as nylon, polyethylene and polypropylene, by molding or stamping.

Such attachment members can be dispensed to couple buttons to fabric, merchandising tags to articles of commerce, and in the general attachment of one item to another, such as the attachment of tubing to a chasses or electrical wiring to a frame.

In U.S. Pat. Nos. 4,121,487; 4,039,078; and 3,948,128 the stock is severed by relatively movable die members to form individual fastener attachments that are dispensed through one or more hollow slotted needles after appropriate positioning. The dispensing mechanism is provided by an ejector which forces an end bar portion of an individual fastener through the bore of a hollow needle during a forward stroke. During the return stroke of the ejector a further individual fastener is moved into position for being dispensed. If the ejector is operated prematurely, before it has completed its return stroke, it can interfere with the positioning and dispensing of the successive fastener.

Another technique for the dispensing of continuously connected fastener stock is disclosed in copending application Ser. No. 827,276, filed Aug. 24, 1977. Here the end bars of the stock, which are dispensed through the bore of a slotted hollow needle, are separated one from the other either during alignment of the end bar with the bore or during the subsequent impact of the ejector with the end bar in the course of driving it through the bore. Any remaining connection of successive fasteners is severed, for example, in the manner illustrated in U.S. Pat. No. 3,733,657. Here again the ejector dispenses an individual fastener during its forward stroke and a successive fastener is positioned for being dispensed during the return stroke. If the ejector is operated prematurely before it has completed its return stroke, it can interfere with the positioning of the successive fasteners as well as with the action of the ejector on those fasteners.

Accordingly it is an object of the invention to facilitate the dispensing of fasteners. A related objective is to facilitate the dispensing of fasteners from connected stock, particularly continuously connected stock.

Another object of the invention is to curtail the occurrence of malfunctions in the dispensing of fasteners. A related object is to curtail the occurrence of malfunctions in the dispensing of fasteners from connected stock, particularly continuously connected stock.

A further object of the invention is to assure completion of the return stroke of the ejector used in the dispensing of fasteners. A related object is to assure the completion of the return stroke of the ejector in the dispensing of fasteners from connected stock, particularly continuously connected stock.

Still another object is to curtail the occurrence of possible premature operation in the dispensing of fasteners, particularly from continuously connected stock.

Representative prior art dealing with individual fasteners is to be found in the following U.S. Pat. Nos. 3,103,666; 3,470,834; 3,494,004; 3,185,367; 3,650,451, 3,650,452; 3,652,004; 3,734,375 and 3,299,483.

SUMMARY OF THE INVENTION

In the practice of the invention, an attachment member formed by a filament with a head at one end and an end or cross bar at the opposite end, is moved into position for being dispensed by an ejector which has forward and return strokes. The attachment member desirably is from continuously connected stock. During the forward stroke an individual attachment member is dispensed. During the return stroke an antijam mechanism is used to assure completion of the return stroke and to prevent premature forward operation of the ejector.

In accordance with one aspect of the invention the antijam mechanism is in the form of a lever which is pivotted into and out of the path of the ejector.

In accordance with another aspect of the invention the antijam mechanism is positioned midway between a support for the ejector and an indexing mechanism which positions the fasteners for being dispensed. This positioning of the antijam mechanism allows it to be held out of the path of the ejector during the forward stroke, while allowing it to pivot into the path of the ejector during the return stroke. It thus can prevent premature termination of the return stroke and subsequent attempts to reactuate the ejector and initiate a premature forward stroke.

In accordance with still another aspect of the invention the antijam mechanism is provided with a cam that is acted upon by a complimentary cam on a slidable member which is used to assure that the antijam mechanism is pivoted out of the path of the ejector during the forward stroke.

DESCRIPTION OF THE DRAWINGS

Other aspects of the invention will become apparent after considering several illustrative embodiments taken in conjunction with the drawings.

DETAILED DESCRIPTION

Figure 1:
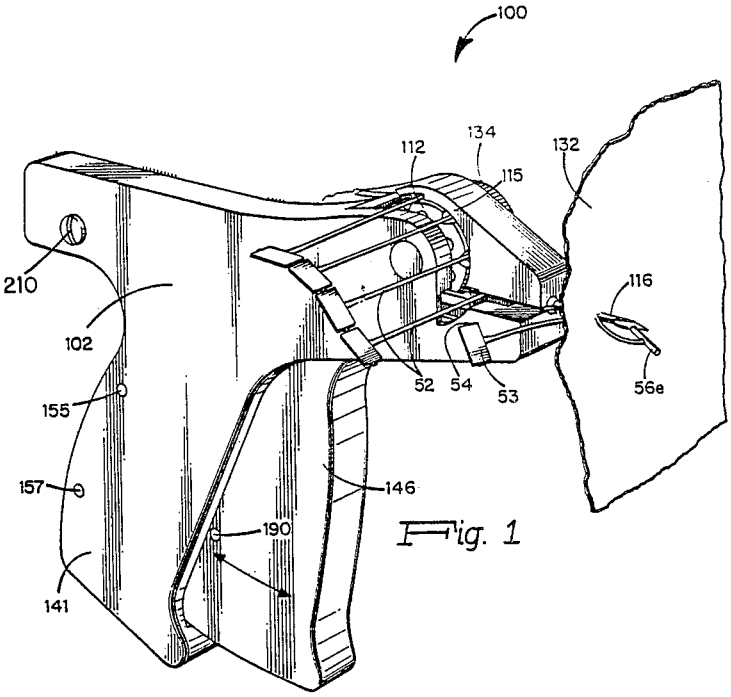
FIG. 1 is a perspective view of a dispensing apparatus in accordance with the invention, illustrating the insertion of a fastener into a layer of material.
Figure 2:
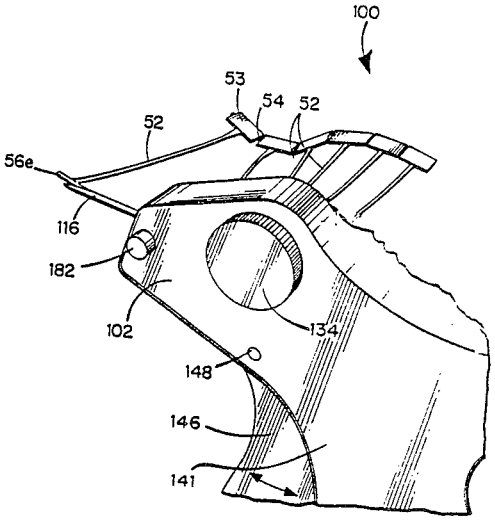
FIG. 2 is a partial perspective view of the opposite front portion of the dispensing apparatus of FIG. 1.

With reference to the drawings, an apparatus or gun 100 for dispensing attachment members 52 in accordance with the invention is shown in FIG. 1.

The gun 100 is formed by a hollow casing 102 and is hand actuated by a trigger 146. The casing 102 is preferably in two halves joined together in conventional fashion using, for example, screw fasteners 210 and is fabricated from any convenient material, such as molded plastic.

The fasteners 52 are continuously connected and are desirably fed from a suitable magazine or storage compartment (not shown) which may be within the gun 100 or attached as an accessory. The fasteners are advantageously of the type shown in U.S. Pat. No. 4,121,487, which issued Oct. 24, 1978. Each individual fastener includes a filament which extends between a head member and an opposite end member. The heads and opposite ends of successive fasteners are joined by thin filaments to form continuously connected fastener stock.

As shown in FIG. 1 the free end of the fastener stock is fed over the periphery of a feed wheel 112 which is journalled for rotation within the casing 102. As can be seen more clearly in FIG. 3, the wheel 112 is provided with notches 114 about its periphery for receiving the filaments of the fasteners 52 and advancing them in an arcuate path to a position adjacent the rear of a forwardly projecting dispensing needle 116.

The needle 116 has a hollow bore that communicates with a longitudinal slot. The end member is driven through the bore with its associated filament protruding through the longitudinal slot.

The advance of the fasteners over the feed wheel 112 is controlled by operation of the trigger 146. As the trigger 146 is released from its recess of the gun handle 141, an individual fastener is moved into position in ultimate alignment with the bore of the needle 116.

Figure 3:
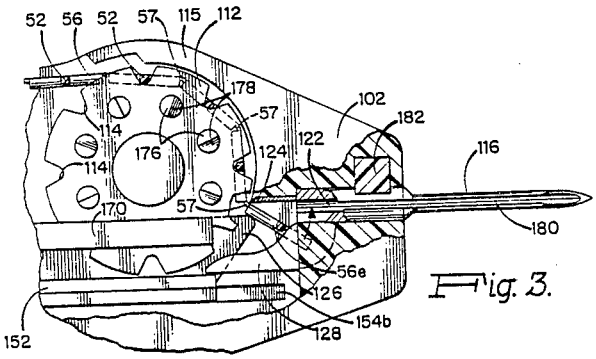
FIG. 3 is a sectional view of the front portion of the dispensing apparatus of FIG. 1.

As indicated in FIG. 3 the end bar which approaches the extension of the bore of the needle 116 is disposed at approximately a right angle to the center line of the bore. The end bar, as indicated by reference **56*e*, is subsequently rotated into alignment with the bore and by a reciprocating cam member 126. The rotation of the end bar 56*e* can be sufficient to separate the fastener being dispensed from the associated stock by the breakage of the filament 57. If the rotation does not break the connection, the force of the ejector will do so. In addition a separate cutter can be used in the head portion 102** of the gun.

When the needle has been inserted into a layer of material 132, the end **56*e* of the fastener is expelled from the end of the needle 116. As the needle is withdrawn from the material 132, the end-bar 56*e* will resiliently resume its transverse position with respect to the filament. This will prevent withdrawal of the filament from the material. Motion of the tool as it is removed from the material 132 will break the connector 54 joining tab 53 to the next following tab in the manner illustrated for example in U.S. Pat. No. 3,733,657. For this purpose, connector 54** should be relatively weak. Any other suitable means for severing may be provided.

The needle 116 is held in place by a needle lock 182.

The feed wheel 112 shown in FIG. 3 is spaced from the inner wall of the casing 102 to define a passageway for receiving and guiding the fastener end bars, including the bar **56*e*, as the wheel rotates. A loading door 115 overhangs the wheel 112 to aid in restraining the end bars for travel within the passageway and provides an easy loading feature. The notches 114 of the wheel 112 are spaced about the periphery by a distance approximately equal to the spacing between successive filaments of the fasteners 52**.

Figure 4:
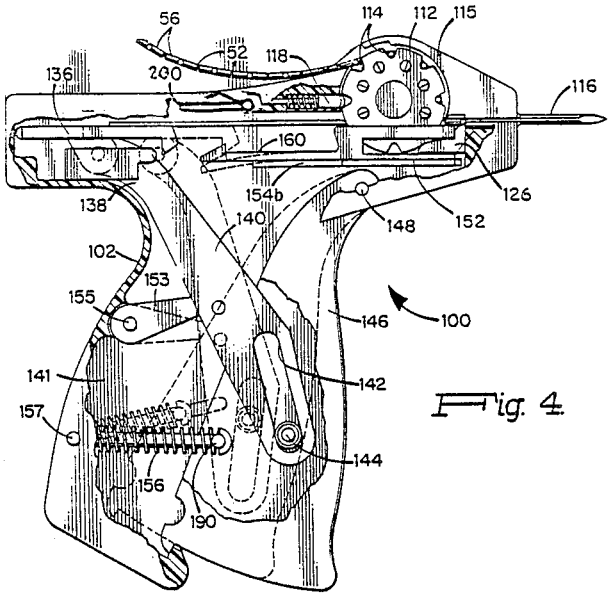
FIG. 4 is a plan view of the apparatus of FIG. 1 with portions of the casing broken away to expose the operative interior mechanism, with broken layers illustrating the position of the components when the mechanism has been partially operated.
Figure 5:
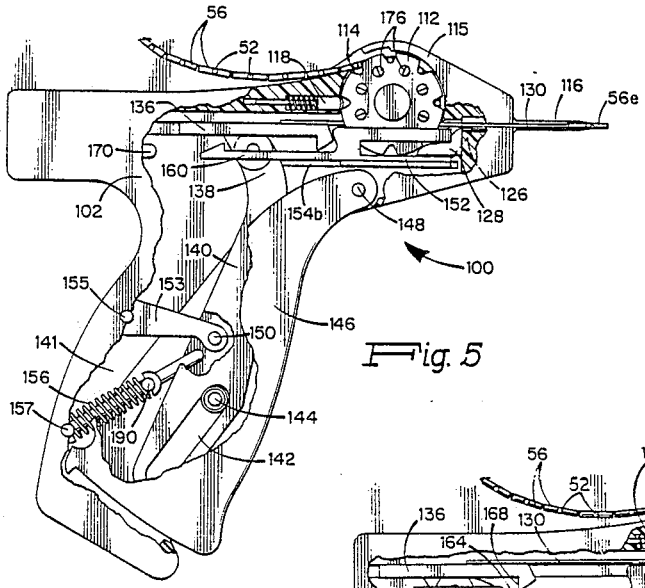
FIG. 5 is a view of the apparatus of FIG. 4 with the trigger fully compressed and the mechanism fully operated during the forward stroke of the ejector by which the fastener illustrated in FIG. 1 is expelled from the device.
Figure 6:
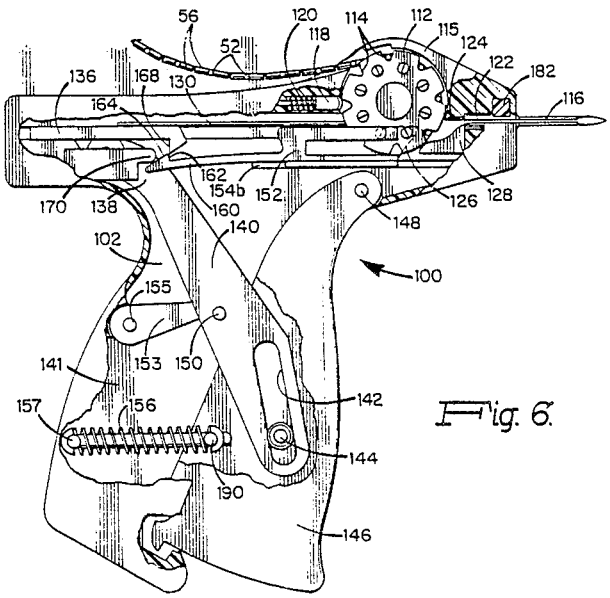
FIG. 6 is a further view of the gun of FIG. 4 illustrating the return stroke of the ejector.

As shown in FIG. 4, a detent pin 118 is included in the casing 102 and biased by a spring 120 to restrain backward movement of the wheel 112.

In addition, as indicated in FIG. 4, the gun 100 includes an antijam mechanism 200. This mechanism prevents premature operation of the gun before the plunger 130 has completed its rearward stroke after having expelled the end bar **56*e* through the needle 116** during a forward stroke.

After the end-most fastener end-bar **56*e* has been indexed about the feed wheel 112, it occupies a position transverse to the rear end of the bore 122 of the needle 116 (FIG. 3). A severing edge 124 may be secured to the needle or to the casing opposite the connector 57 connecting end bar 56*e* with the end bar of the next following fastener. A reciprocating cam member 126 shown in FIGS. 4–9 is then advanced to rotate the end-most end bar 56*e* about its connector as a hinge into alignment with the bore of the needle. A projecting tab 128 is provided in the casing in the vertical plane of wheel 112 forming an extension of the passageway about the wheel for the end bars to guide the same during rotation. Tab 128 has a curved upper surface configured to guide the filament projecting from the wheel as the end bar 56*e*** is rotated into alignment.

After the end bar is aligned with the needle bore 122, a plunger 130 is brought forward to contact the free rear end of aligned end bar **56*e* to push it through the hollow needle bore, simultaneously breaking or cutting connector 57 at severing means 124. As illustrated in FIG. 1, the plunger drives the end bar through the hollow needle which, if inserted through one or more layers of material 132** will secure them together or will secure a tag thereto.

As shown in FIGS. 4–9 plunger 130 is fixed at its rearward end to a rear slide or plunger support 136 which slides back and forth within slide grooves in the casing to reciprocate the plunger in and out of the needle bore 122. Slide 136 is pivotally joined to the upper end 138 of lever member 140 which extends downwardly into the hollow handle portion 141 of the casing 102. The lower end of lever member 140 is secured by means of slot 142 to a pin 144 carried by hollow trigger 146 which is pivotally joined at 148 to casing 102 for movement back and forth within hollow handle 141. Pin 144 acts as a cam and the wall of slot 142 as a cam follower to impart motion to the lever member 140. Member 140 is joined intermediate its ends to a floating pivot 150 which is secured to one end of member 153, the opposite end of which is pivotally secured at 155 to the handle 141. Trigger 146 is biased in the open position by means of compression spring 156 described more fully hereinafter. Lever member 140 is biased by the spring 156 to retain the plunger support 136 in its rearward position. Upon squeezing the handle 141 and trigger 146, member 140 pivots about floating pivot point 150 to actuate support 136, causing it to slide from its rearward to its forward position, pushing the plunger through the needle bore 122 and ejecting a fastener end bar through the needle. Plunger 130 is withdrawn from the needle bore by the energy stored in spring 156 when pressure on the trigger is released.

Figure 7:
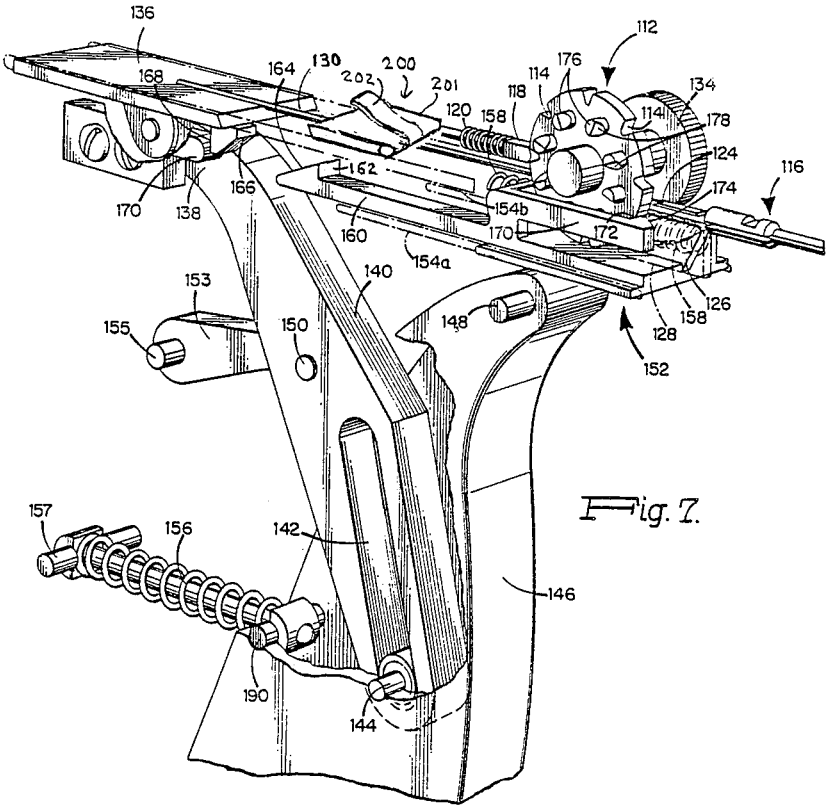
FIG. 7 is a perspective exploded view of the gun of FIGS. 1–6 showing its internal mechanism.
Figure 8:
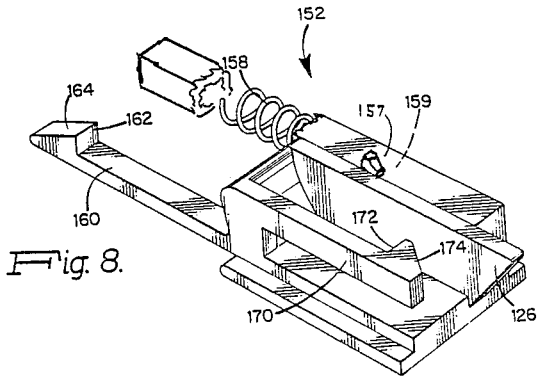
FIG. 8 is a perspective view of a cam slide device which is used to operate the indexing mechanism of the gun shown in FIGS. 1–7 as well as the antijam mechanism in accordance with this invention.
Figure 9:
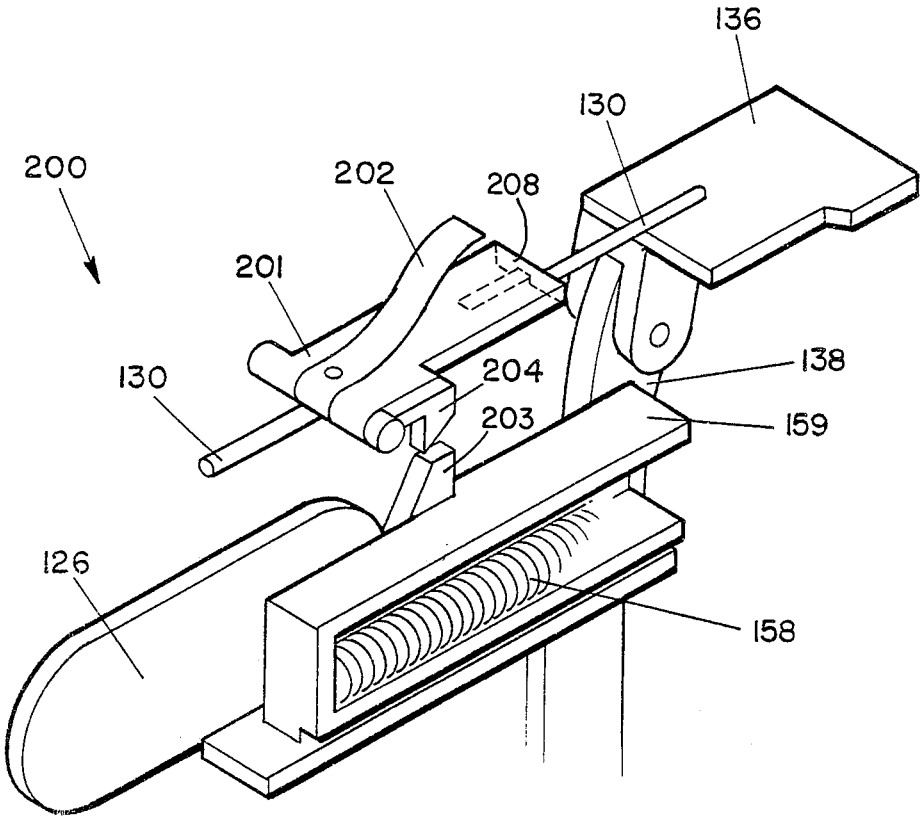
FIG. 9 is a partial perspective view of the mechanism shown in FIG. 7 from the opposite side showing details of the antijam mechanism in accordance with the invention.

A forward slide 152, shown in FIG. 7 and in detail in FIG. 8, is mounted in the forward end of casing 102 and slides back and forth in slide grooves 154*a* and 154*b* in the casing. Slide 152 has a recess 159 which, together with the interior wall of the casing, houses a compression spring 158 which constitutes means for biasing the slide 152 in its forward position. Slide 152 has a rearwardly extending flexible arm 160 which has at its rearward end a detent surface 162 and an inclined cam surface 164. Plunger support 136 carries a cooperating cam surface 166 and detent surface 168 which actuates slide 152 as follows. When the trigger 146 is squeezed, and lever member 140 is actuated to advance plunger support 136, cam surface 166 rides up and over cam surface 164, deflecting flexible arm 160. On the return stroke of plunger support 136, detent surfaces 162 and 168 engage as shown for example in FIG. 6 and the plunger support 136 then moves slide 152 rearwardly, compressing biasing spring 158.

As the plunger support 136 approaches its rearward position, a fixed cam 170 mounted to the casing engages a rearward extension of cam surface 164 which deflects arm 160 downwardly until the detent surfaces 162 and 168 are disengaged. Upon such disengagement, compressed biasing spring 158 causes slide 152 to return to its forward position. Cam 126 is carried by the slide 152 and on its forward stroke rotates end bar 56*e* into alignment with the needle bore 122.

Slide 152 has a second forwardly extending resilient arm 170 which has a rearwardly facing detent surface 172 and a forward cam surface 174. Feed wheel 112 is provided with cooperating index pins 176, one for each indexing position, each of which has a cam surface 178. As the slide 152 is drawn rearwardly by plunger support 136, cam surface 172 engages a pin 176 to rotate feed wheel 112 and feed the next fastener into position with its end bar transverse to the longitudinal axis of the needle bore. On the return forward stroke of slide 152, cam surface 174 rides up and over cam surface 178 of the lower pin 176 to deflect arm 171 and allow its passage into its forward position ready for the next indexing stroke.

If, during the return stroke of the plunger 130 the trigger 146 is operated before the return stroke is completed, it could be possible to advance another fastener into the needle 116 and produce a jam. This kind of premature operation is forestalled by an antijam mechanism 200, which includes a lever 201 journalled between the parts 102 of the gun 100 above the path of travel of the ejector 130 and between the feed wheel 114 and the rearmost position of the plunger support 136.

The antijam lever 201 is pivoted into the path of the returning support 136 by a leaf spring 202 after the returning support 136 has cleared the position of the antijam lever 201. As a result of this action an inadvertent depression of the trigger 146 before the plunger support has returned to its return stroke position cannot cause a premature forward motion of the plunger 130 into the bore of the needle 116, since the path of the support 136 is now blocked by the trailing edge 208 of the antijam lever 201.

However, at the end of the return stroke of the plunger 130, with the support 136 in its most rearward position, the slide 159 is released and the uncoiling of the compression spring 158 drives the slide forwardly causing a cam 203 mounted on the housing 159 to engage a cam 204 of the antijam lever 201 and pivot and hold the antijam lever 201 out of the path of the rear platform 136. Consequently the gun is operable on the next cycle since there is nothing to block the forward stroke of the plunger 130, but as before on the return stroke the antijam lever pivots into a blocking position to prevent any premature operation of the device.

The needle 116 can be a hollow slotted needle of any known type suitable for feeding flexible fasteners, the fastener end bar being dispensed through the hollow bore of the needle and the filament extending through and sliding within the communicating slot 180. Needle 116 is preferably removably secured to the forward end of the casing 102 by means of a pin 182.

The operation of the dispensing apparatus is as follows:

(1) A coil of fastener stock is placed in or on the gun 100. The free end is fed over feed wheel 112 and the loading door 115 is closed. Two (2) cycles of the tool are required to advance the fastener into the needle bore.

(2) Trigger 146 is squeezed against handle 141 to rotate lever member 140 about pivot 150, thereby compressing return spring 156 and sliding plunger support 136 forward, cam surface 166 sliding over and deflecting cam surface 164.

(3) Trigger 146 is released, spring 156 causing support 136 to return to its rearward position. As support 136 returns, slide 152 is moved to its rear position and spring 158 is compressed until cooperating detents 162 and 168 are disengaged by deflection of arm 160 by cam surfaces 170 and 164. On the rearward stroke of slide 152, detent 172 on arm 171 engages pin 176 of feed wheel 112 to index the wheel and feed end bar 56*e* to the position shown in FIG. 3. As slide 152 returns to its forward position, cam surfaces 174 and 178 engage to deflect arm 170, and cam 126 rotates end bar 56*e* about connector 57 into alignment with needle bore 122 as shown in FIG. 3.

(4) The antijam mechanism 200 operates to prevent premature operation of the trigger 146. Once the return stroke of the ejector 130 is completed (within a fraction of a second) the gun is ready for the next cycle of operation.

(5) Trigger 146 is again squeezed to move plunger support 136 and plunger 130 forwardly to engage the exposed end of end bar 56*e* and dispense it through the bore 122, edge 124 severing the connector 57.

(6) As trigger 146 is again released, the sequence described in (3) above is repeated to prepare the next end bar for dispensing.

While the apparatus described is well adapted for hand operation, the operations may be powered by any suitable means, for example, by means of electrical devices or fluid pressure. And while the novel fastener stock herein described is well adapted for use in the method and apparatus described, other suitable fastener stock can be employed.

It should be further understood that the present invention includes all modifications and equivalents within the scope of the appended claims.

We claim:

1. Apparatus for dispensing attachment members, each being formed by a filament with a head at one end and a cross bar at the other end and being moved into position for being dispensed, comprising means having forward and return strokes for ejecting an attachment member from the apparatus during a forward stroke, and antijam means for preventing the premature operation of the ejecting means.

2. Apparatus as defined in claim 1 wherein the ejecting means operates reciprocally with forward and return strokes and the antijam means occupies a first position during the forward stroke and a second, antijam position during the return stroke.

3. Apparatus as defined in claim 2 wherein the antijam means is a spring loaded pivotted lever which is pivotted into the path of the ejector during and before completion of the return stroke thereof.

4. Apparatus as defined in claim 3 wherein the antijam lever is pivotted out of the path of the ejection member during the forward stroke of an indexing slide member.

5. Apparatus as defined in claim 4 wherein the antijam lever contains a cam which is acted upon during the forward stroke of the indexing slide member.

6. Apparatus for dispensing fasteners, each having a flexible filament terminating in an end bar, comprising a casing, a dispensing needle mounted on said casing and having a longitudinal bore for slidably accommodating said end bar and a slot communicating with said bore for said filament, means for advancing a fastener from a first position remote from said needle to a second position adjacent the rear end thereof with the end bar disposed at an angle to the longitudinal axis of the bore, means for aligning the end bar with the bore, means for dispensing the end bar through the bore, and means for controlling the stroke of the dispensing means to prevent premature operation thereof.

7. Apparatus according to claim 6 further comprising means for storing fastener stock comprising a plurality of fasteners having their end bars joined end to end by severable connectors, said apparatus further including means for severing the connector between adjacent end bars when one of said end bars is aligned with said bore.

8. Apparatus according to claim 6 wherein said advancing means comprises a wheel having means for engaging the filaments of said stock to advance the end fastener in an arcuate path to said second position.

9. Apparatus according to claim 8 further including biasing detent means for retarding motion of said wheel.

10. Apparatus according to claim 6 wherein said means for aligning the fastener end bar with said bore comprises a cam movable back and forth within said casing to rotate said end bar about the connector joining it to the next adjacent end bar and into alignment with said bore.

11. Apparatus according to claim 6 wherein said needle is removably mounted in the forward portion of said casing by means of a locking pin, said pin and needle including interlocking parts mutually engagable to secure the needle to the casing, said pin being movable between two positions engaging and disengaging said needle interlocking portion, said casing including biasing means urging the pin into its normal interlocking position.

12. Apparatus according to claim 6 wherein said needle is mounted in the front portion of said casing, said apparatus further comprising forward and rearward slides mounted for movement back and forth within said casing, means biasing the rear slide in its rear position, means biasing the front slide in its front position, and means for moving said rearward slide toward said needle, said rearward slide being adapted to actuate said fastener advancing means and said aligning means, said slides having cooperating means engagable on the return stroke of said rearward slide to move said forward slide to its rearward position.

* * * * *